United States Patent [19]

Hellström et al.

[11] 4,381,580

[45] May 3, 1983

[54] VERTICALLY ADJUSTABLE HINGE

[75] Inventors: Eric Hellström, Filipstad; Lennart Helm, Gothenburg, both of Sweden

[73] Assignee: Nykroppaverken AB, Nykroppa, Sweden

[21] Appl. No.: 233,301

[22] Filed: Feb. 10, 1981

[30] Foreign Application Priority Data

Feb. 26, 1980 [SE] Sweden ..... 8001484

[51] Int. Cl.[3] ..... E05D 7/04

[52] U.S. Cl. ..... 16/243

[58] Field of Search ..... 16/243, 245, 381, 387

[56] References Cited

U.S. PATENT DOCUMENTS 863,128 8/1907 Aebi ..... 16/243

1,097,458 5/1914 McKinney ..... 16/387

FOREIGN PATENT DOCUMENTS 2254978 7/1975 France ..... 16/243

676661 7/1952 United Kingdom ..... 16/243

*Primary Examiner*—Werner H. Schroeder

*Assistant Examiner*—Andrew M. Falik

*Attorney, Agent, or Firm*—Dennison, Meserole, Pollack & Scheiner

[57] ABSTRACT

When hanging doors in a door-frame hinges are usually used consisting of two parts (1 and 7), one part (7) being fixed to the door-frame and provided with an upwardly directed pin (9) and the other part (1) being fixed to the door and provided with a sleeve (2) for threading over the pin (9). If an alarm arrangement is to be fitted, for instance, it is desirable to be able to accurately adjust the door in a vertical direction. According to the invention this is done with the help of the second part (1) of a hinge since its sleeve (2) is provided at the top end with a closure (4), the depth of penetration of this into the sleeve (2) being adjustable.

1 Claim, 3 Drawing Figures

VERTICALLY ADJUSTABLE HINGE

The present invention relates to hinges, preferably hinges which can be used for doors. Normally a door-hinge consists of two parts, a part which is fixed to the door-frame and includes an upwardly directed pin and a part which is secured to the door itself and is provided with a sleeve to be threaded onto the pin in the first part. A problem often arises when hanging a door, and that is that the door shall assume a predetermined position in relation to the frame both so that the door can be closed and also because the position of the door must be adjusted in relation to members included in an alarm system. The vertical position of the door is often adjusted using washers of various thicknesses which are placed on the pin in the first part of the hinge. Suggestions have also been made to make the pin itself adjustable in vertical direction by means of a special screw mechanism. The pin must then be provided with special peripheral grooves cooperating with inwardly directed protuberances in the sleeve so that the pin does not leave its sleeve. Such an arrangement for adjusting the height of a door is exceptionally expensive. Despite the need for a cheaper design, only the two above mentioned approaches have materialized to adjust a door in vertical direction.

The object of the present invention is to provide a hinge which will adjust the position of a door in vertical direction in a simpler and less expensive manner and where the adjustment can be performed extremely accurately. According to the invention the pin in one hinge portion is fixed to this hinge portion and stationary in relation thereto. However, the other hinge portion is provided with a sleeve for threading onto the pin. The end of the sleeve opposite to the end to be threaded over the pin is provided with a closure, the penetration depth of which into the sleeve is adjustable. The penetrating end of the closure cooperates with the free end up to the pin penetrating into the sleeve.

According to the invention the closure consists of a screw which is screwed into said end of the sleeve to the closed, said end being provided with an internal screw-thread cooperating with the thread of the screw.

According to the present invention the sleeve may suitably be sprung so that the screwed closure is subjected to a clamping action. The sleeve is preferably formed from a bent piece and is thus provided with two meeting edges in axial direction, which can be moved towards or away from each other. When the closure end of the sleeve is screwed out these edges will be parted from each other and upon screwing in the edges will approach each other so that said clamping action occurs.

Additional features of the present invention will be evident from the following claims.

Figure 1:
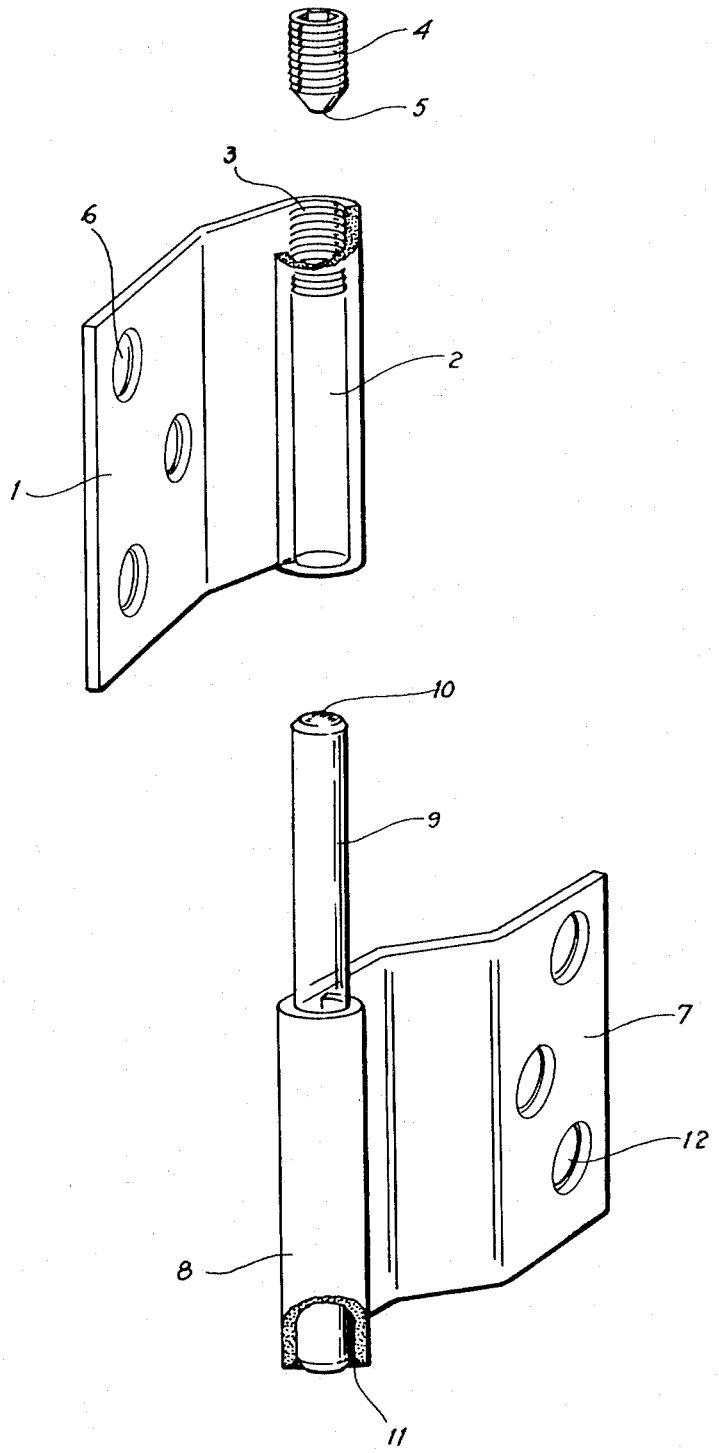
Figure 2:
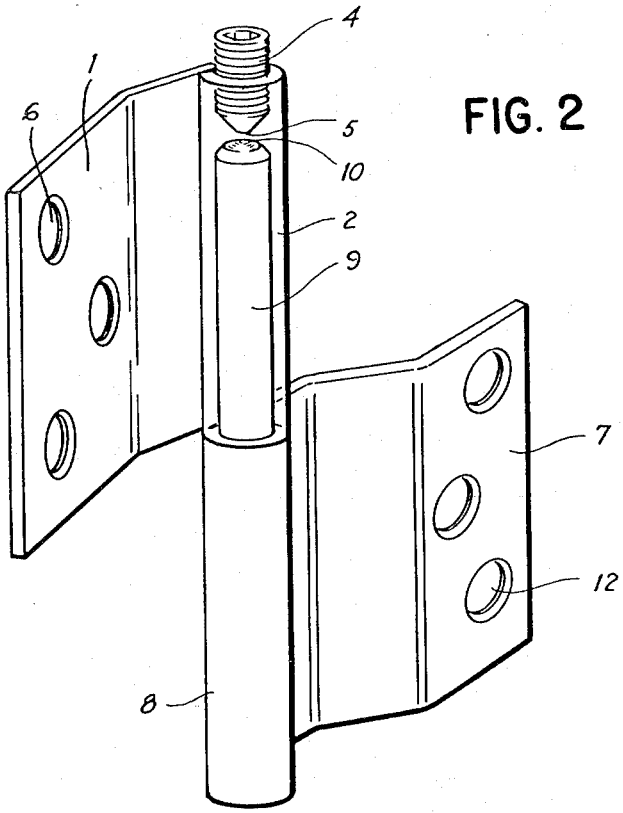
Figure 3:
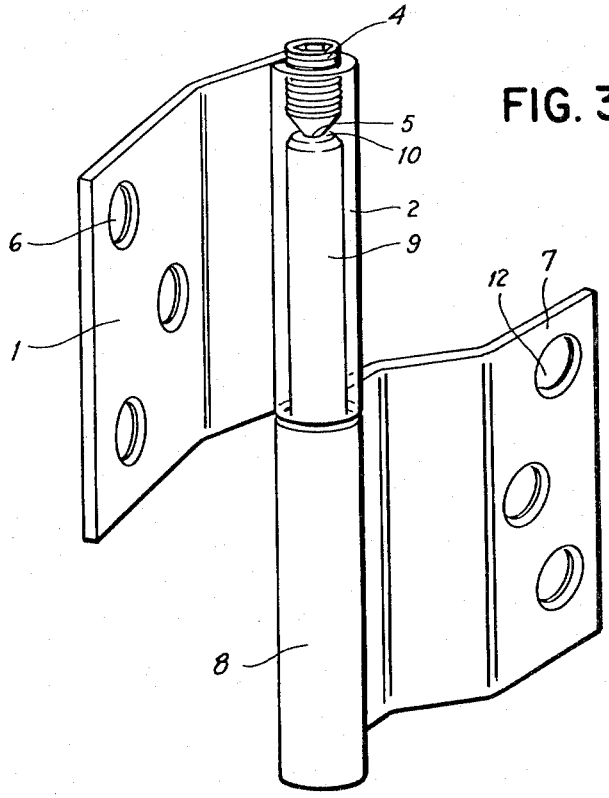

The present invention will be described more fully with reference to the accompanying three figures in which FIG. 1 shows the two hinge portions separated from each other and the closure of one of the hinge portions, FIG. 2 shows the two hinge portions cooperating with each other, with the closure at a first penetration depth and FIG. 3 shows the two hinge portions cooperating with each other, with the closure at a second penetration depth.

The drawings show two hinge portions, one of which consists of an attachment flange 1 the vertical edge of which is folded to form a sleeve 2. The sleeve formed is provided with a screw-thread 3 at its top end. When making the screw-thread 3 a certain force occurs which endeavours to open the sleeve. The thread 3 is intended to receive a screw 4 with journalling tip 5. When the screw 4 is screwed into the thread 3 it is clamped to a certain extent since the thread was produced from a bent part and the procedure thus caused the sleeve to tend to open. The flange 1 is provided with a number of screw holes 6 for attachment.

The hinge portion described above is designed to cooperate with a second hinge portion consisting of a flange 7, the right-hand edge of which is bent to form a sleeve 8. A pin 9 is inserted into the sleeve, the bottom end of the pin being welded to the sleeve 8 by a peripheral weld 11. The top of the pin is provided with a journalling tip 10 for cooperation with the journalling tip 5 of the screw 4. The flange 7 is provided with a number of screw holes 12 for attachment.

The hinge portion comprising the flange 1 is designed for attachment to a door and that comprising the flange 7 is designed for attachment to a door-frame. When the door is to be mounted, the screw 4 is screwed into the hinge portion with the flange 1. The hinge portion with the flange 7 will penetrate with its pin into the sleeve 2 until its journalling tip 10 makes contact with the journalling tip 5. By screwing the screw 4 in or out the vertical position of the door can be adjusted extremely accurately which may be necessary if there is to be an alarm system on the door. FIG. 2 shows the full penetration depth of the pin 9 in the sleeve 2 and FIG. 3 is a limited penetration depth.

An extremely simple hinge is created by means of the present invention, which is easy to adjust so that the extent to which the pin is inserted gives the correct position for the two hinge portions in relation to each other.

It should be clear that the hinge according to the present invention can find many applications apart from being used for doors.

We claim:

1. Hinge construction for doors or the like comprising first and second hinge parts adapted for mounting respectively on a stationary member and a movable member for hingedly mounting said movable member to said stationary member, said first hinge part comprising a first mounting flange, a first sleeve fixed to said first flange, and a hinge pin fixed within said first sleeve and protruding therefrom, said second hinge part comprising a second mounting flange having a rolled edge portion defining a second sleeve, said rolled edge portion terminating in a free edge adjacent the second flange for selective movement relative thereto and a resiliently resisted expansion of the second sleeve due to inherent resiliency of the material of the second hinge part, said second sleeve having opposed open end portions, said first and second sleeves being of substantially the same diameter with the second sleeve adapted to align over the first sleeve with the protruding pin received therein through a first end portion thereof, the second end portion of said second sleeve being internally threaded, a screw element threaded within the second end portion and defining a limit means to the insertion of the pin protruding from the first sleeve, said screw element being longitudinally adjustable within said second end to vary the degree of penetration of the pin into the second sleeve, said screw element being of a size relative to said second end portion as to effect a slight resilient expansion of the second end portion and a corresponding clamping of the screw element therein.

* * * * *